US007479033B1

(12) United States Patent
Sykes et al.

(10) Patent No.: US 7,479,033 B1
(45) Date of Patent: Jan. 20, 2009

(54) HIGH PERFORMANCE COAXIAL CONNECTOR

(75) Inventors: Michael T. Sykes, Harrisburg, PA (US); Kevin E. Weidner, Hummelstown, PA (US); Troy E. Conner, York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/781,448

(22) Filed: Jul. 23, 2007

(51) Int. Cl.
*H01R 9/05* (2006.01)

(52) U.S. Cl. ..... 439/578

(58) Field of Classification Search ..... 439/578–585, 439/610, 78, 554
See application file for complete search history.

(56) References Cited

U.S. PATENT DOCUMENTS 2,881,479 A 4/1959 Quackenbush
4,307,926 A * 12/1981 Smith ..... 439/610
4,340,269 A 7/1982 McGeary
4,550,967 A 11/1985 Riches et al.
4,575,694 A 3/1986 Lapke et al.
4,609,242 A * 9/1986 Kemppainen ..... 439/78
4,759,729 A * 7/1988 Kemppainen et al. ..... 439/580
4,941,831 A 7/1990 Tengler et al.
6,409,534 B1 6/2002 Weisz-Margulescu
6,428,354 B1 8/2002 Meyer et al.
6,450,829 B1 9/2002 Weisz-Margulescu
6,808,407 B1 10/2004 Cannon
7,081,016 B2 7/2006 Tateno

* cited by examiner

*Primary Examiner*—Edwin A. Leon

(57) ABSTRACT

A high performance coaxial connector used to terminate a coaxial cable and provide an electrical connection to a mating coaxial connector is disclosed. The coaxial connector is formed with few individual parts and may be configured to provide enhanced electrical performance greater than or equal to 4 GHz.

13 Claims, 7 Drawing Sheets

HIGH PERFORMANCE COAXIAL CONNECTOR

FIELD OF THE INVENTION

The present invention relates to coaxial cable connectors. More specifically, the present relates to a coaxial connector and method of manufacture.

BACKGROUND OF THE INVENTION

Coaxial cable connectors are commonly used to terminate coaxial cables and provide an electrical connection to a mating coaxial cable connector. The male coaxial connector includes a metallic housing having a cylindrical sleeve. Centrally disposed within the sleeve is a center contact pin. The center contact pin is maintained in coaxial alignment within the sleeve by means of an optimized dielectric.

Past coaxial connector designs have been complex and have utilized costly manufacturing procedures. The individual parts may be machined or die cast. The assembly often has required several hand assembly steps to form the final connector. Therefore, a need exists to provide an inexpensive yet high performance coaxial connector that requires minimal assembly steps.

Furthermore, the geometry of the pin, spacer and sleeve are mutually selected for the coaxial connector to have a prescribed radio frequency (RF) performance. Past connector designs have an electrical performance of 4 GHz or less at 50 ohms characteristic impedance and 2 GHz or less at 75 ohms characteristic impedance, while a need exists to provide enhanced electrical performance greater than or equal to 4 GHz.

In the prior art, many coaxial connector designs have been proposed, but all fail to provide a simple construction having a small number of components. These multi-component connectors are complex to produce. Additionally, these past connectors have failed to provide enhanced electrical performance characteristics.

Therefore, there is an unmet need to provide a coaxial connector that is inexpensive and provides enhanced electrical performance, and that is formed by a simple manufacturing process.

SUMMARY OF THE INVENTION

This invention provides for a coaxial connector and method of manufacture. According to an exemplary embodiment, a coaxial connector is provided that includes a shell comprising a front cylindrical section having slots and a collar having a rear edge. The front cylindrical section includes slots configured to receive locking pins of a mating jack connector. The connector further includes a center conductor housing having a forward cylindrical section, a flange, and a crimp section disposed coaxially within the shell, an optimized dielectric positioned between the shell and the flange, and a spring mechanism between the flange and the rear edge. The connector is configured to allow the center conductor housing axial movement within the shell. An optimized dielectric spacer is disposed coaxially within the forward cylindrical section. The spring mechanism may be a spring washer or a wavy washer.

The forward cylindrical section includes barbs for securing the dielectric therewithin. The forward cylindrical section also has forward extending tines. The shell further includes flaps configured to partially cover the slots. The rear edge of the collar is formed by folding collar tabs. The dielectric includes an axial through hole configured to receive a conductive pin. The connector is configured to provide enhanced electrical performance greater than or equal to 4 GHz.

According to another exemplary embodiment, a coaxial connector assembly is disclosed that includes a coaxial connector including a shell having a front cylindrical section, a collar having a rear edge, a center conductor housing having a forward cylindrical section, a flange, and a crimp section disposed coaxially within the shell. A dielectric is positioned between the shell and the flange and a spring mechanism is positioned between the flange and the rear edge. The connector is configured to allow the center conductor housing axial movement within the shell. A dielectric is disposed coaxially within the forward cylindrical section. The dielectric has an axially aligned through hole configured to receive a conductive pin. The conductive pin attaches to a coaxial cable center wire.

The assembly further includes a crimping sleeve to attach a coaxial cable to the crimp section. The forward cylindrical section has barbs for securing the dielectric therewithin. The forward cylindrical section also has forward extending tines. The shell has flaps configured to partially cover the slots and a rear edge formed by folding tabs of the collar. The connector is configured to provide enhanced electrical performance greater than or equal to 4 GHz.

According to yet another exemplary embodiment, a method of forming an exemplary coaxial connector is disclosed that includes providing an intermediate shell having a forward cylindrical portion and a collar having tabs, inserting a gasket into the shell, inserting an inner conductive housing having a front receiving portion, a flange, and a crimping portion into the shell whereby the flange contacts the gasket, placing a spring mechanism in contact with the flange, and folding the tabs of the collar against the spring mechanism to form the male coaxial connector.

The method further includes disposing a dielectric within the receiving portion of the inner conductive housing. The method additionally includes attaching a conductive pin to a center wire of a coaxial cable, inserting the conductive pin into a through hole of the dielectric, and crimping a locking mechanism around the coaxial cable to secure the coaxial cable to the crimping portion of the shell. The dielectric is secured within the receiving portion of the inner conductor by barbs formed into the front receiving section of the inner conductive housing. The connector is configured to provide enhanced electrical performance greater than or equal to 4 GHz.

Further aspects of the method and system are disclosed herein. The features as discussed above, as well as other features and advantages of the present invention will be appreciated and understood by those skilled in the art from the following detailed description and drawings.

DETAILED DESCRIPTION OF THE INVENTION

The present invention now will be described more fully hereinafter with reference to the accompanying drawing, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
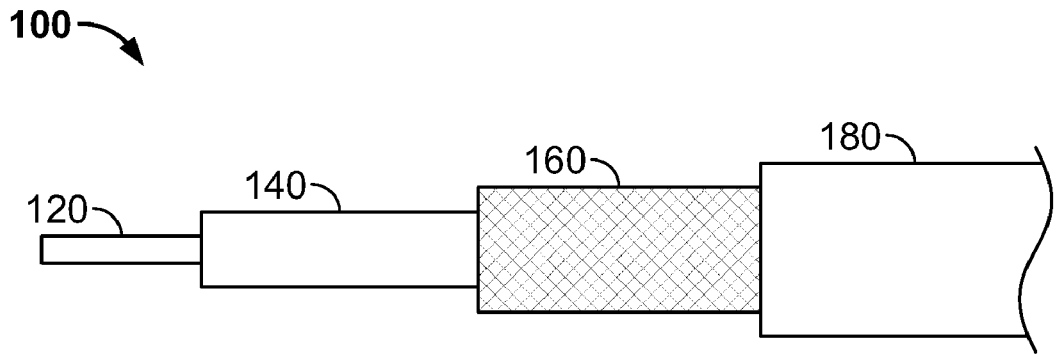
FIG. 1 illustrates an exemplary coaxial cable.

With initial reference to FIG. 1, an exemplary coaxial cable 100 is shown with various layers stripped to expose an electrically conductive center wire 120. A dielectric sheathing 140 surrounds the center wire 120. A flexible, electrically conductive metallic braid, commonly referred to as a ground shield 160, surrounds the dielectric sheathing 140. Finally, a synthetic plastic dielectric outer sheathing 180 surrounds the ground shield 160.

Figure 2:
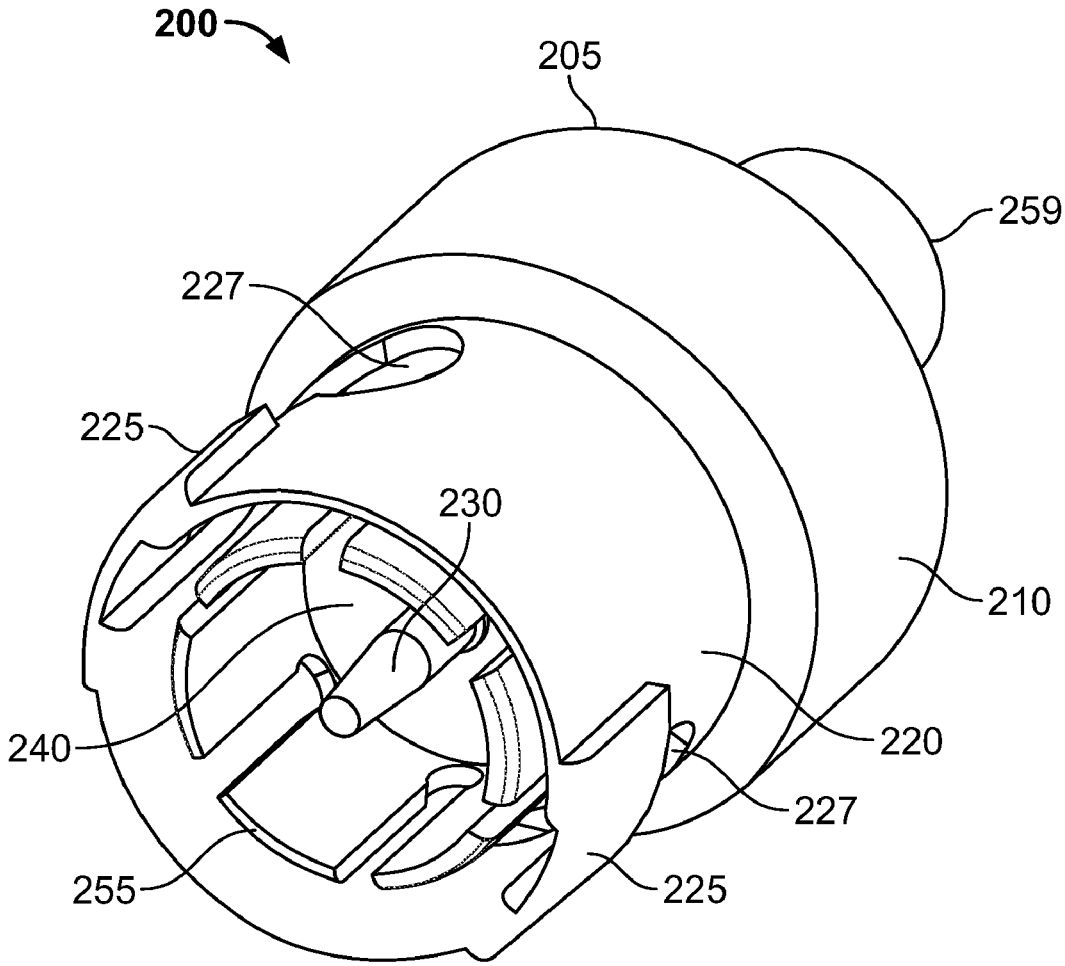
FIG. 2 illustrates an exemplary embodiment of a coaxial connector.

Referring to FIG. 2, an exemplary embodiment of a coaxial connector 200 is shown. The connector 200 includes an outer shell 205 that includes a collar 210 and a forward cylindrical section 220. The forward cylindrical section 220 includes flaps 225 and receiving slots 227. The connector 200 also includes a conductive pin 230 and a dielectric spacer 240. Forward extending tines 255 and crimping section 259 of a center conductive housing 250 (FIG. 3) can be seen in FIG. 2.

Figure 3:
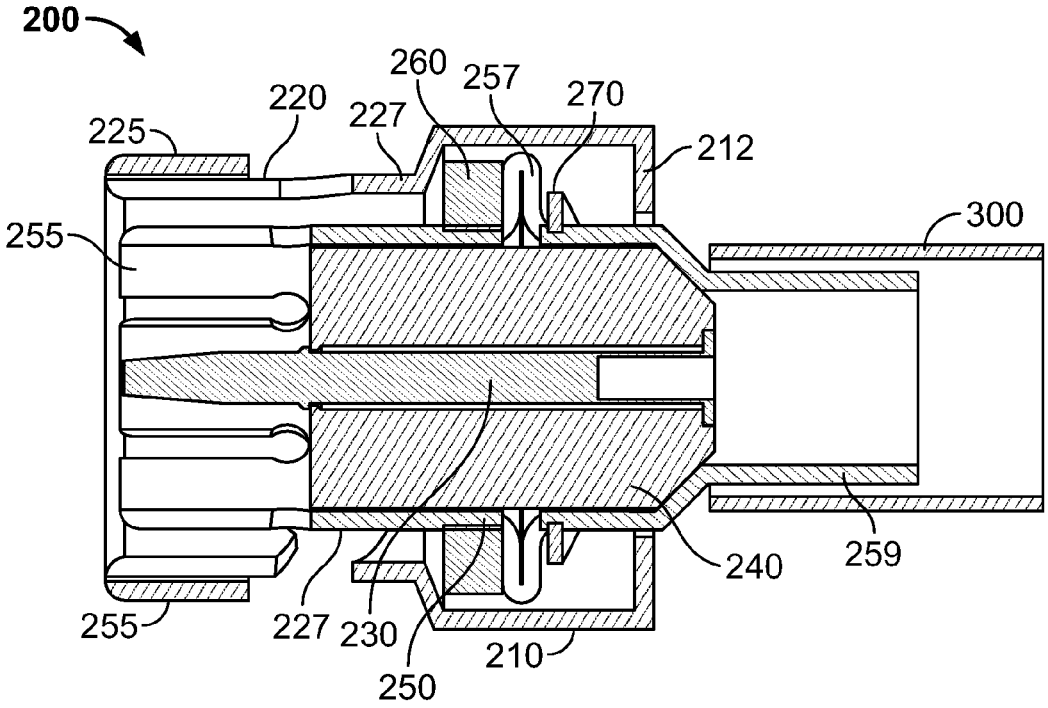
FIG. 3 illustrates a cross section side view of the exemplary embodiment of the coaxial connector.

A cross sectional side view of the connector 200 is shown in FIG. 3. As shown in FIG. 3, the connector 200 also includes a gasket 260 and a spring washer 270. As is further shown, the center conductive housing 250 includes forward extending tines 255, a flange 257, and crimping section 259. The collar 210 includes a rear edge 212. The crimping section 259 is shown with a smooth surface, but may be ridged or textured to improve crimping retention. Additionally shown in FIG. 3 is a crimping sleeve 300 that may be used to attach a coaxial cable 100 (FIG. 1) to the connector 200.

Figure 4:
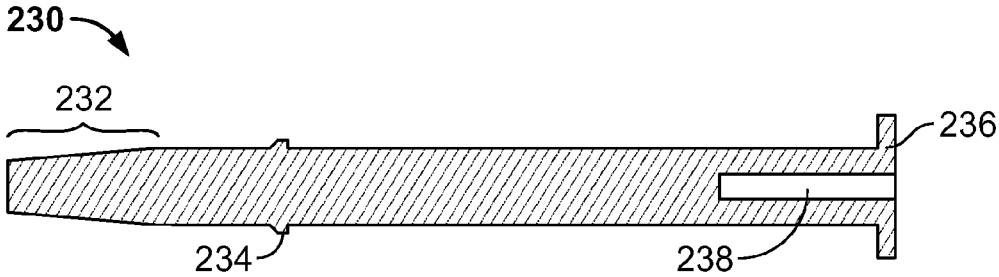
FIG. 4 illustrates a cross section side view of an exemplary embodiment of a conductive pin.

An enlarged sectional side view of the conductive pin 230 is shown in FIG. 4. The conductive pin 230 is formed of a conductive material. The conductive material may be a metal alloy. For example, the metal alloy may be a copper alloy including, but not limited to, copper nickel silicon, brass, and beryllium copper. The conductive material may be plated with a nickel, silver or other conductive finish alloy as is known in the art. As can be seen in FIG. 4, the conductive pin 230 includes a tapered lead section 232, a shoulder ring 234, a base flange 236, and a recess 238. The tapered lead section 232 is used to guide the pin 230 into the dielectric spacer 240 and to mate the pin 230 to a corresponding mating connector (not shown). The shoulder ring 234 provides a resistance fit to the pin 230 when inserted into the dielectric 240. The base flange 236 seats the pin 230 at a predetermined distance into the dielectric 240 (FIG. 3). The recess 238 is configured to receive center wire 120 (FIG. 1) of the coaxial cable 100 (FIG. 1). After the center wire 120 (FIG. 1) is received in the recess 238, the pin 230 is crimped upon the wire 120 (FIG. 1) to provide a secure connection.

Figure 5:
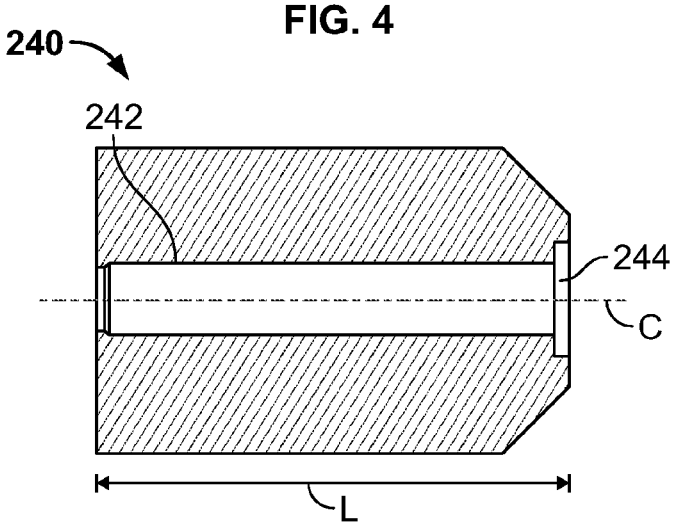
FIG. 5 illustrates a cross section side view of an exemplary embodiment of a dielectric spacer.

FIG. 5 shows a sectional side view of the dielectric 240. The dielectric 240 is formed of a dielectric material. The dielectric material may be a polytetrafluoroethylene (PTFE), a polyethylene, a polypropylene, a polymethylpentene, a polybutylene terephthalate (PBT) or other similar dielectric material. As can be seen in FIG. 5, the dielectric 240 has a generally cylindrical geometry having a length L. The dielectric 240 includes a center axis through hole 242 coaxially disposed around a center axis C. The center axis through hole 242 is configured to receive the conductive pin 230 (as shown in FIG. 2). The dielectric 240 also includes a recess 244 configured to receive the base flange 236 of the conductive pin 230 (FIG. 4). The geometry of the dielectric 240 including length L may be varied to provide a range of electrical performance. The dielectric 240 shown in FIG. 5 is configured to have an enhanced electrical performance greater than or equal to 4 GHz.

Figure 6:
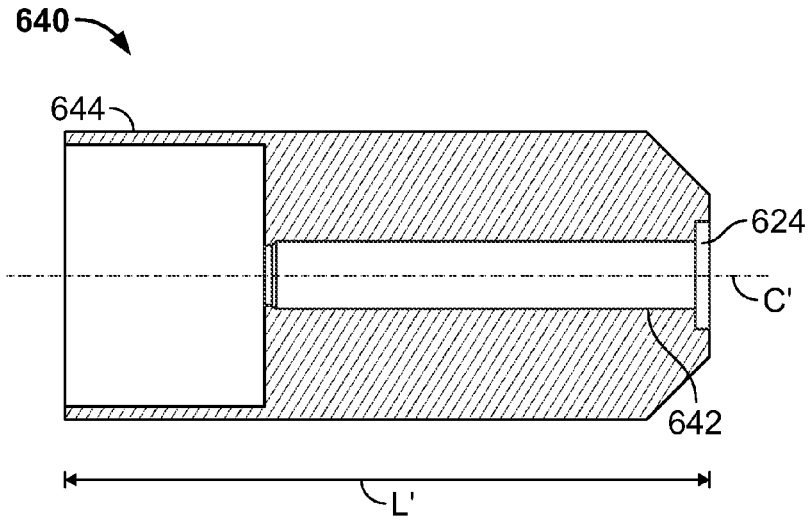
FIG. 6 illustrates a cross section side view of an alternative exemplary embodiment of a dielectric.

An alternative dielectric 640 having an enhanced electrical performance greater than or equal to 4 GHz is shown in FIG. 6. The alternative dielectric 640 may be formed of a polytetrafluoroethylene (PTFE), a polyethylene, a polypropylene, a polymethylpentene, a polybutylene terephthalate (PBT) or other similar dielectric material. As can be seen in FIG. 6, the dielectric 640 includes a length L', a center axis through hole 642 coaxially disposed around a center axis C', a recess 624, and a forward sleeve section 644 coaxially disposed around center axis C'. The center axis through hole 642 is configured to receive the conductive pin 230 (as shown in FIG. 2). Recess 624 is configured to receive the base flange 236 of the conductive pin 230 (FIG. 4). The geometry of the alternative dielectric 640, including length L', may be varied to provide a range of RF performance. The alternative dielectric 640 shown in FIG. 6 is configured to provide enhanced electrical performance greater than or equal to 4 GHz.

Figure 7:
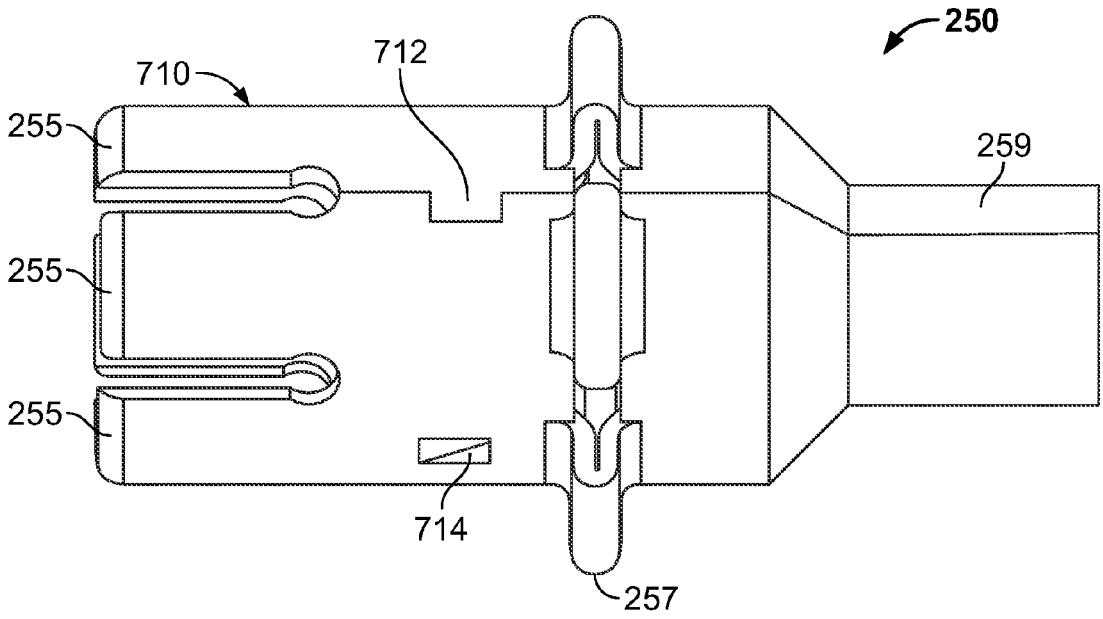
FIG. 7 illustrates a side view of an exemplary embodiment of a center conductive housing.

A side view of the center conductive housing 250 is shown in FIG. 7. The center conductive housing 250 is formed of a conductive material. The conductive material may be a metal alloy. For example, the metal alloy may be a copper alloy including, but not limited to, copper nickel silicon, brass, and beryllium copper. The conductive material may be plated with a nickel, silver or other conductive finish alloy as is known in the art. The housing 250 includes forward extending tines 255, a flange 257 and a crimping section 259. Housing 250 also includes a cylindrical section 710 which includes tab 712 and slot 714. Locking tab 712 is configured to assist in joining the cylindrical section 710 during the fabrication of the housing 250. Although housing 250 is shown with a single tab 712, the housing may be formed with no tab 712, more than one tab, or with some other configuration to assist in fabricating the housing 250.

Figure 8:
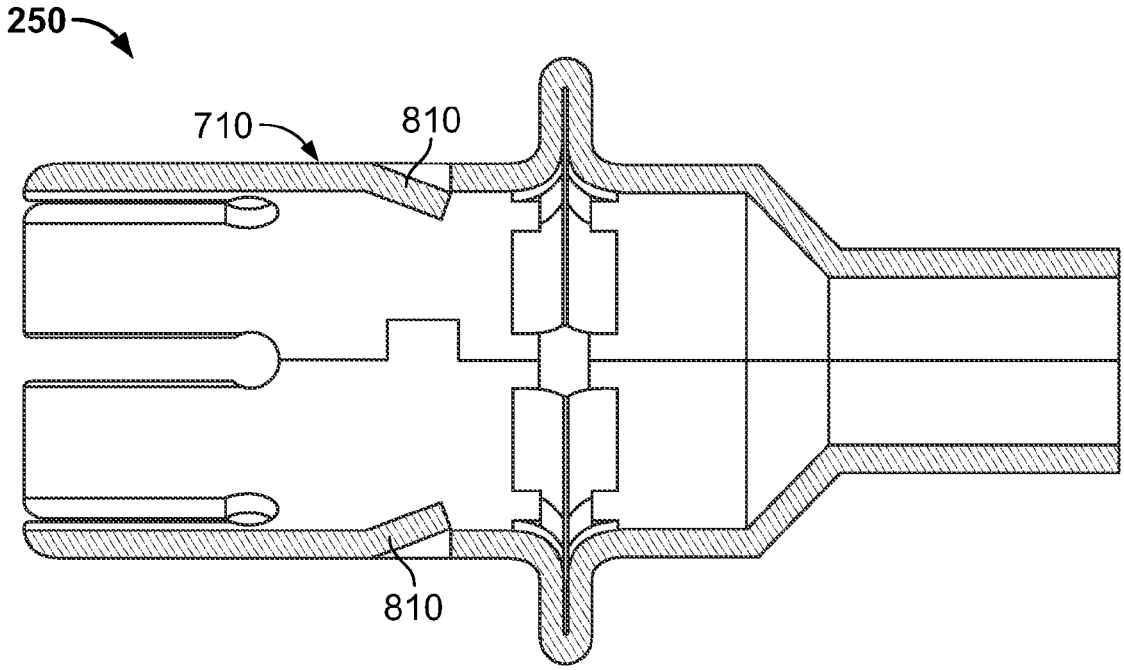
FIG. 8 illustrates a sectional side view of the exemplary embodiment of the center conductive housing of FIG. 7.

A sectional side view of the housing 250 is shown in FIG. 8. As can be seen in FIG. 8, the forward cylindrical section 710 includes locking barb 810 that is formed of displaced material pressed inward when the slot 714 is formed in the housing 250. The barb 810 secures the dielectric spacer 240 within the housing 250.

Figure 9:
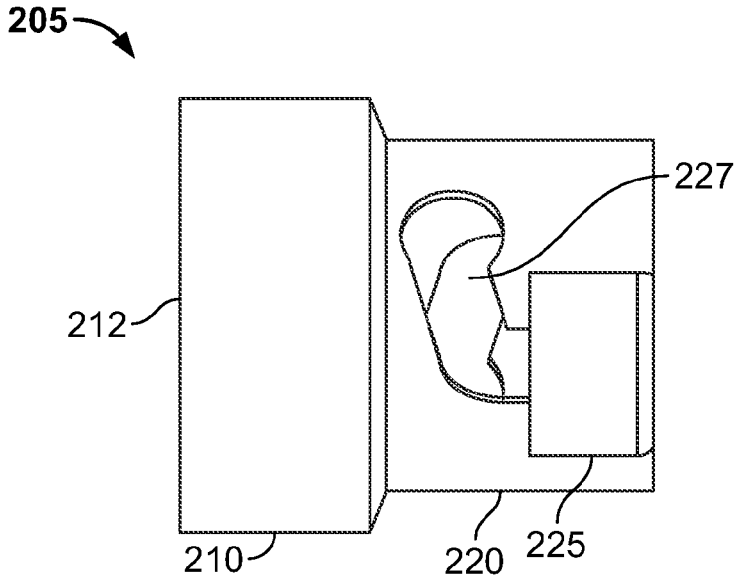
FIG. 9 illustrates a side view of an exemplary embodiment of a shell.

A side view of the shell 205 is shown in FIG. 9. As can be seen in FIG. 9, the shell 205 includes a collar 210 and a forward cylindrical section 220. The shell 205 is formed of a conductive material. The conductive material may be a metal alloy. For example, the metal alloy may be a copper alloy including, but not limited to, copper nickel silicon, brass, and beryllium copper. The conductive material may be plated with a nickel, silver or other conductive finish alloy as is known in the art. The forward cylindrical portion includes flaps 225. Flaps 225 at least partially cover slots 227 as shown. The collar 210 includes rear edge 212.

A more clear understanding of the configuration of the shell 205 can be provided by understanding an exemplary fabrication process for forming the shell 205. The shell 205 is first formed by stamping a conductive material sheet into a predetermined shape. The conductive material may be a metal alloy. For example, the metal alloy may be a copper alloy including, but not limited to, copper nickel silicon, brass, and beryllium copper. The conductive material may be plated with a nickel, silver or other conductive finish alloy as is known in the art. The stamped sheet is then rolled and worked into an exemplary partially formed shell 1000 as shown in FIG. 10.

Figure 10:
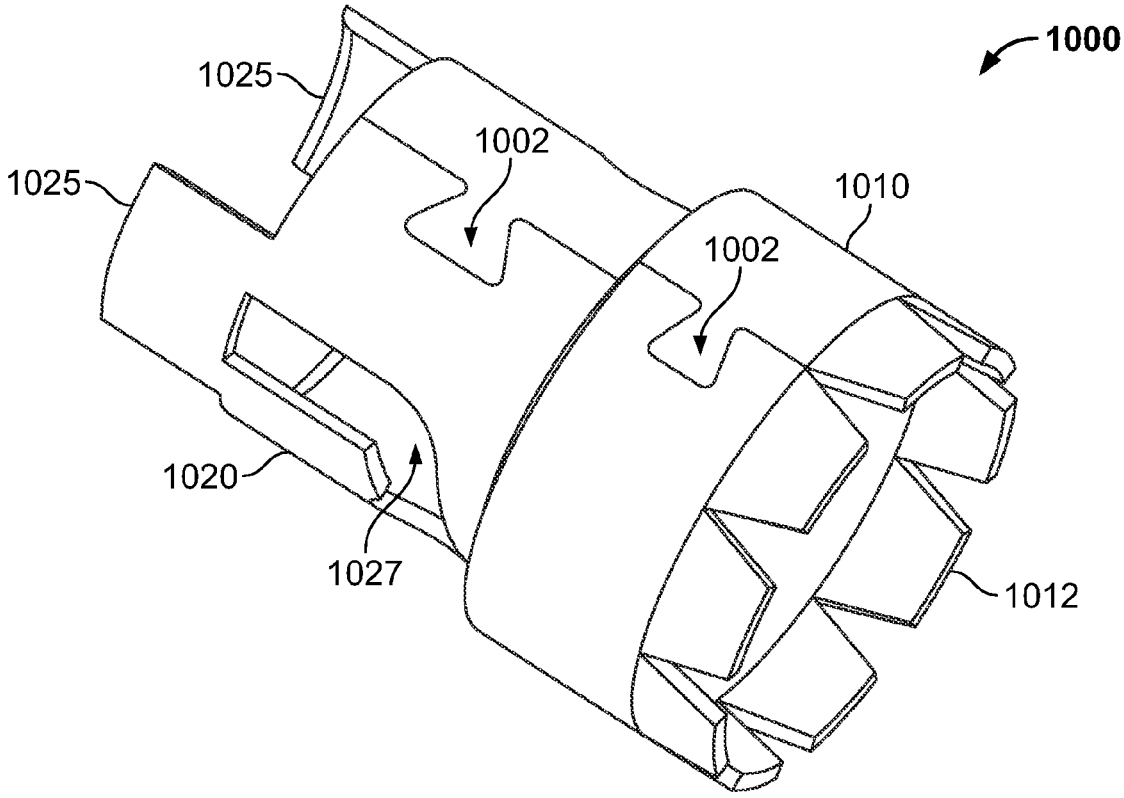
FIG. 10 illustrates an exemplary embodiment of a partially formed shell.

As shown in FIG. 10, the partially formed shell 1000 includes interlocking tabs 1002 that provide strength and rigidity to the shell 1000. The partially formed shell 1000 further includes a collar 1010 and a front cylindrical section 1020. The collar 1010 includes rear tabs 1012. The front cylindrical portion 1020 includes forward flaps 1025 and slot 1027.

Figure 11:
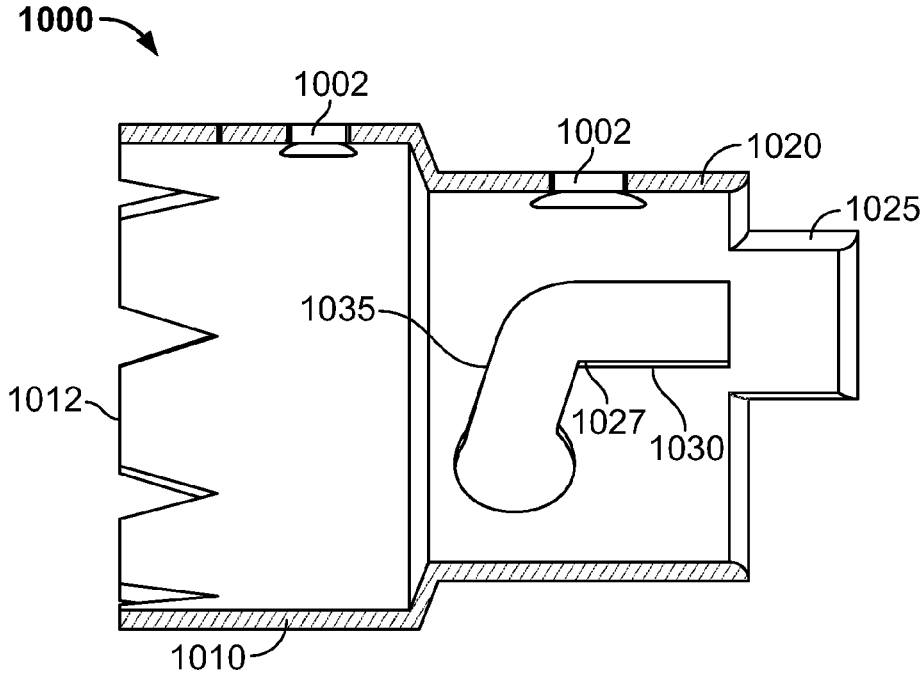
FIG. 11 illustrates a side view of the exemplary embodiment of the partially formed shell of FIG. 10.
Figure 12:
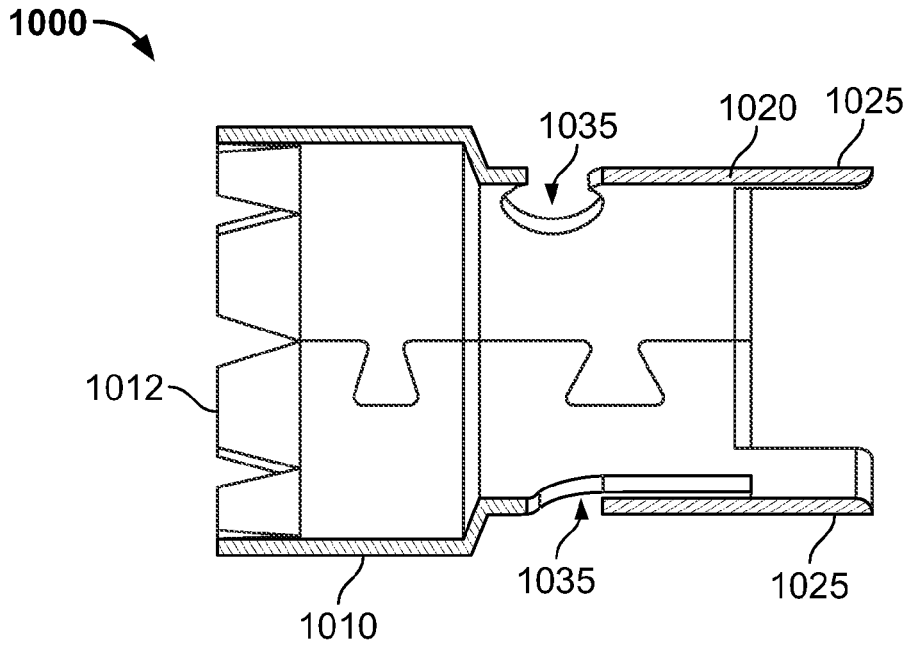
FIG. 12 illustrates a cutaway top view of the exemplary embodiment of the partially formed shell of FIG. 10.

A cross sectional side view of the partially formed shell 1000 is shown in FIG. 11. As shown in FIG. 11, the slot 1027 includes a receiving section 1030 and a locking section 1035. As can be seen in the cutaway top view of the partially formed shell 1000 in FIG. 12, a slot 1027 having an opposite orientation of the locking section 1035 of the side view of FIG. 11 is located on the opposite side of the cylindrical section 1020 as shown. As can be seen in FIG. 12, the two locking sections 1035 are reverse configured upon the cylindrical section 1020. In other words, the locking section 1035 of the side view of FIG. 11 points generally downward, and the locking section 1035 on the opposite side of the cylindrical section 1020 as shown in FIG. 12 generally points upward. In this manner, a mating coaxial connector (not shown) having engaging pins configured to engage the slots 1027, is directed into the receiving sections 1030 and inserted and rotated until the pins are engaged by the locking sections 1035.

Figure 13:
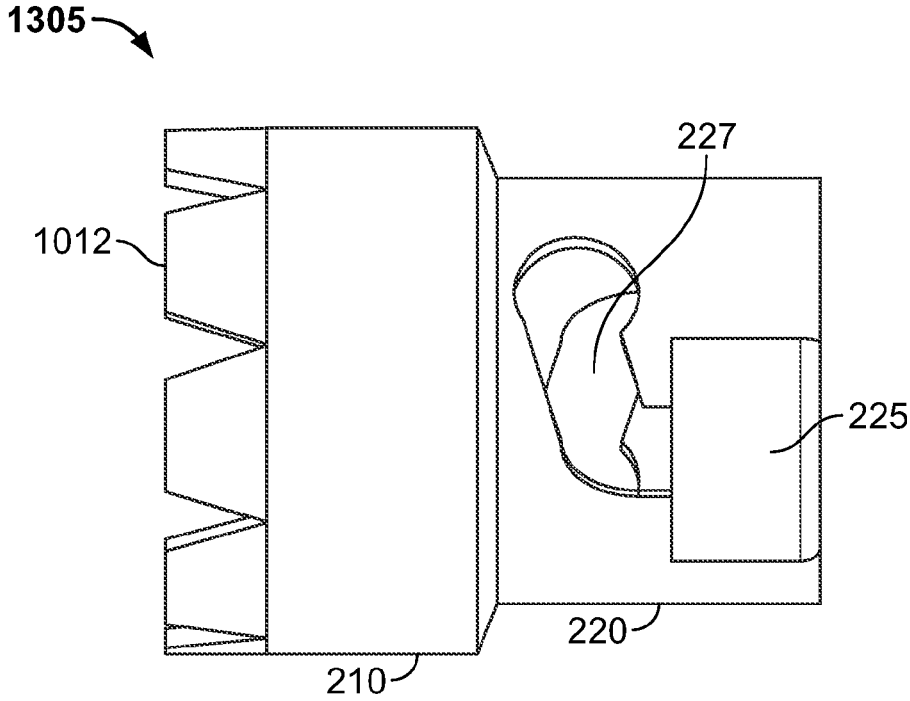
FIG. 13 illustrates an exemplary embodiment of a pre-assembled shell.

The forward flaps 1025 (FIG. 12) are then folded back upon the front cylindrical section 1020 to form the pre-assembled shell 1305 of FIG. 13. As shown in FIG. 13, the pre-assembled shell 1305 includes flaps 225. The flaps 225 cover a substantial portion of the receiving section 1030 (FIG. 12) of the slot 1027. The flaps 225 provide strength and rigidity to the front cylindrical section 220. The pre-assembled shell 1305 may then be plated. The plating may be a nickel alloy, gold alloy, palladium alloy or other similar plating material as is known in the art. The intermediate shell 1305 is then similar to the shell 205 (FIG. 9) except that the rear tabs 1012 have not been folded inward to form the rear edge 212 (FIG. 3).

Figure 14:
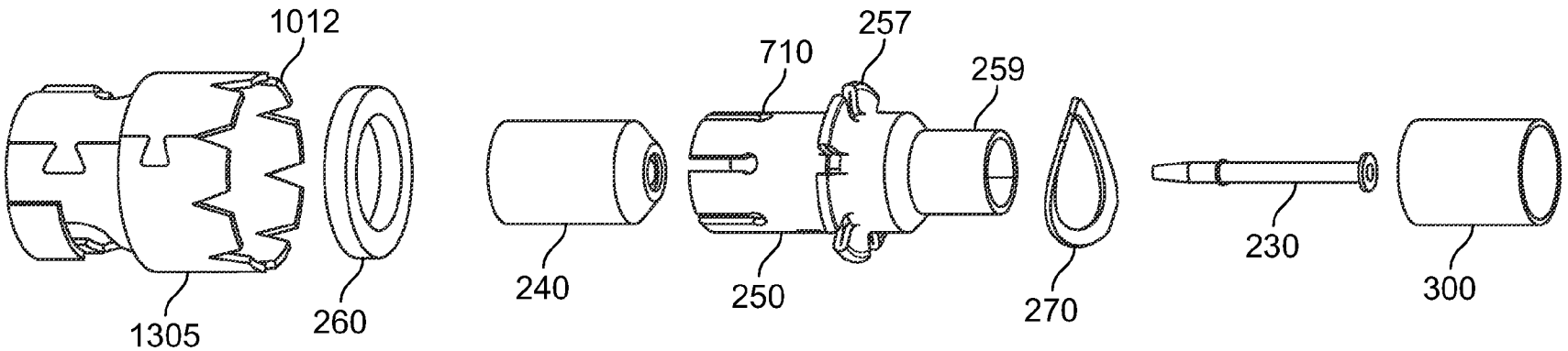
FIG. 14 illustrates an exploded view of an exemplary embodiment of an assembly of connector components.

The assembly of the connector 200 will now be explained referring to the expanded view of FIG. 14. First, the gasket 260 is directed into pre-assembled shell 1305 until the gasket 260 abuts forward cylindrical section 220 as shown in FIG. 3. Then, the conductive center housing 250 is inserted into the pre-assembled shell 1305 until the flange 257 is in contact with the gasket 260 as shown in FIG. 3. A spring mechanism such as spring washer 270 is then directed upon the conductive center housing 250 against the flange 257 as shown in FIG. 3. The rear tabs 1012 of the pre-assembled shell 1305 are then folded or rolled inward until they form the rear edge 212 as shown in FIG. 3. The dielectric 240 may be placed in the cylindrical section 710 as shown in FIG. 3 before or after the housing 250 is placed against the gasket 260. After the dielectric 240 is placed in the housing 250 and the tabs 1012 are folded inward to form the rear edge 212 as shown in FIG. 3, a coaxial cable (FIG. 1) may be attached.

The coaxial cable (FIG. 1) is attached by crimping the conductive pin 230 over the center wire 120 (FIG. 1) and a crimping sleeve 300 is placed around the coaxial cable 100 (FIG. 1). The conductive pin 230 is then inserted into the dielectric 240 until the base flange 236 (FIG. 4) contacts the recess 244 (FIG. 5) of the dielectric 240. At the same time, the crimping section 259 of the housing 150 is brought between the dielectric sheathing 140 (FIG. 1) and the conductive mesh 160 (FIG. 1) of coaxial cable 100 (FIG. 1). The conductive braid 160 (FIG. 1) is flared and then the crimping sleeve 300 is then placed around the conductive braid 160 (FIG. 1) and crimped to securely attach the coaxial cable 100 (FIG. 1) to the connector 200 (FIG. 3).

As can be appreciated by one of skill in the art, and referring to FIG. 3, the connector 200 is configured to allow the center housing 250 to move by the compressive distance of the spring washer 270. In such a manner, a mating coaxial connector (not shown) may be inserted into the connector 200 and locked into place by the receiving slots 227, while maintaining spring forces within the inter-connect system.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A coaxial connector, comprising:

a shell comprising a front cylindrical section and a collar having a rear edge adjacent the collar;

the front cylindrical section comprising slots configured to receive locking pins of a female connector;

a center conductor housing comprising a forward cylindrical section, a flange, and a crimp section disposed coaxially within the shell;

a gasket positioned between the shell and the flange;

a spring mechanism disposed between the flange and the rear rolled edge wherein the spring mechanism allows the center conductor housing axial movement within the shell; and a dielectric disposed coaxially within the forward cylindrical section;

wherein the collar comprises tabs that are folded inward to form the rear edge that urges the spring mechanism toward the center conductor.

2. The connector of claim 1, wherein the forward cylindrical section comprises displaced material for securing the dielectric therewithin.

3. The connector of claim 1, wherein the forward cylindrical section further comprises forward extending tines.

4. The connector of claim 1, wherein the shell further comprises flaps configured to partially cover the slots.

5. The connector of claim 1, wherein the dielectric spacer comprises an axial through hole configured to receive a conductive pin.

6. The connector of claim 1, wherein the connector is configured to provide enhanced electrical performance greater than or equal to 4 GHz.

7. A coaxial connector assembly, comprising:

a coaxial connector comprising:

a shell comprising a front cylindrical section having slots and a collar having a rear edge;

a center conductor housing comprising a forward cylindrical section, a flange, and a crimp section disposed coaxially within the shell;

a gasket positioned between the shell and the flange;

a spring mechanism disposed between the flange and the rear edge configured to allow the center conductor housing axial movement within the shell; and a dielectric spacer disposed coaxially within the forward cylindrical section, the dielectric spacer comprising an axially aligned through hole configured to receive a conductive pin;

wherein the collar comprises tabs that are folded inward to form the rear edge that urges the spring mechanism toward the center conductor; and a conductive pin for attachment to a coaxial cable center wire.

8. The connector assembly of claim 7, further comprising a crimping sleeve to attach a coaxial cable to the crimp section.

9. The connector assembly of claim 7, wherein the forward cylindrical section comprises displaced material for securing the dielectric spacer within the forward cylindrical section.

10. The connector assembly of claim 7, wherein the forward cylindrical section further comprises forward extending tines.

11. The connector assembly of claim 7, wherein the shell further comprises flaps configured to partially cover the slots.

12. The connector assembly of claim 7, wherein the flaps are formed by folding forward flaps of the front cylindrical section.

13. The connector assembly of claim 7, wherein the connector is configured to provide enhanced electrical performance greater than or equal to 4 GHz.

* * * * *